US006199850B1

(12) United States Patent
Seki

(10) Patent No.: US 6,199,850 B1
(45) Date of Patent: Mar. 13, 2001

(54) SHEET TRANSPORT SYSTEM FOR AN IMAGE-FORMING APPARATUS INCLUDING A PLURAL PATH SHEET PILING SYSTEM

(75) Inventor: Nobuyoshi Seki, Okazaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/005,019

(22) Filed: Jan. 9, 1998

(30) Foreign Application Priority Data

| | | |
|---|---|---|
| Jan. 9, 1997 | (JP) | 9-002227 |
| Aug. 7, 1997 | (JP) | 9-213532 |
| Sep. 19, 1997 | (JP) | 9-255395 |
| Oct. 28, 1997 | (JP) | 9-295813 |
| Nov. 13, 1997 | (JP) | 9-312189 |

(51) Int. Cl.[7] ..... B65H 29/20

(52) U.S. Cl. ..... 270/58.07; 414/790.08; 271/177; 270/58.01; 270/59

(58) Field of Search ..... 270/58.01, 58.07, 270/58.11, 58.23, 59; 414/790.08; 271/177, 258.02

(56) References Cited

U.S. PATENT DOCUMENTS

| | | | |
|---|---|---|---|
| 4,534,643 | 8/1985 | Watanabe . | |
| 4,548,393 * | 10/1985 | Irvine et al. | 270/59 |
| 5,021,837 | 6/1991 | Uto et al. . | |
| 5,037,077 | 8/1991 | Kubota et al. . | |
| 5,056,774 | 10/1991 | Kubota et al. . | |
| 5,072,920 | 12/1991 | Kubota et al. . | |
| 5,083,760 | 1/1992 | Yamazaki et al. . | |
| 5,096,176 * | 3/1992 | Golicz et al. | 270/58.31 |
| 5,121,911 | 6/1992 | Yamazaki et al. . | |
| 5,201,873 | 4/1993 | Kikuchi et al. . | |
| 5,263,697 | 11/1993 | Yamazaki et al. . | |
| 5,272,511 * | 12/1993 | Conrad et al. | 270/59 |
| 5,289,251 * | 2/1994 | Mandel et al. | 270/59 |
| 5,297,783 * | 3/1994 | Howard et al. | 270/59 X |
| 5,320,336 * | 6/1994 | Asami | 270/58.08 |
| 5,344,130 | 8/1994 | Suzuki et al. . | |
| 5,383,656 * | 1/1995 | Mandel et al. | 271/177 X |
| 5,445,368 * | 8/1995 | Lester et al. | 270/59 |
| 5,447,298 | 9/1995 | Watanabe et al. . | |
| 5,524,873 | 6/1996 | Hosoi et al. . | |
| 5,709,376 | 1/1998 | Ushirogata . | |

FOREIGN PATENT DOCUMENTS 5-286619 * 2/1993 (JP) .

OTHER PUBLICATIONS

Patent Abstracts of Japan, JP 63–272748, Nov. 10, 1988.
Patent Abstracts of Japan, JP 07–076190, Mar. 20, 1995.

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

A finisher system for image formed sheets transported from an image forming apparatus. A finisher finishes the image formed sheets. A direct sheet feeding path feeds the image formed sheets to a sheet stacker. A sheet finishing path branches from the direct sheet path and transports the image forming sheets to the sheet stacker by way of the finisher. A sheet piling system is set upstream from a turning point at which the sheet finishing path branches from the direct sheet feeding path along the sheet transport direction and piles up the image formed sheets. A stopper is set upstream from the turning point to temporally trap the image formed sheets.

29 Claims, 14 Drawing Sheets

SHEET TRANSPORT SYSTEM FOR AN IMAGE-FORMING APPARATUS INCLUDING A PLURAL PATH SHEET PILING SYSTEM

BACKGROUND OF THE INVENTION

1. Field of the Invention

This invention relates to a finisher for an image forming apparatus, for example a copy machine, printer or similar image forming apparatus, and particularly to a sheet transport system which simultaneously transports plural sheets from an image forming apparatus to an image formed sheet stacker by way of a finisher.

2. Discussion of the Background Art

In a background finisher of an image forming apparatus, the finisher receives and stacks image formed sheets from an image forming apparatus and then carries out various finishing processes on the image formed sheets. As examples of the finishing processes, the finisher can staple, make holes, fold, stamp the image formed sheets, etc.

In a case that a finisher is combined with an automatic document feeder (ADF) in an image forming apparatus, for example, the finisher may receive a second set of image formed sheets after a first set of image formed sheets is stapled and transported to the image formed sheet stacker. However, in this case the total finishing operation time becomes longer than the image forming process time because the finisher system requires both a finishing operation time, such as a time for stapling, and a transporting time for transporting sheets from the finisher to the image formed sheet stacker.

Therefore, as such a finishing time is longer than an image forming time, the image forming operation may be suspended until the finishing operation ends. When the image forming operation is thus suspended, the productivity of the image forming apparatus decreases.

Some attempts to solve this problem involve simultaneously transporting piled plural image formed sheets to a finisher. Specifically, a finisher system may include a plural sheet transport path between an image formed sheet receiver and a finisher. The finisher system can then temporally suspend a part of a set of image formed sheets which are to be finished in the above plural sheet transport path.

One such system is disclosed in Japanese Laid Open Patent Application 5-286619 and as shown in FIGS. 1 and 2. FIG. 1 is a cross-sectional view of this background sheet path system with finisher in which a finisher system 313 includes a first sheet transport path 312 and a second sheet transport path 311 which is longer than the first sheet transport path 312; these sheet transport paths 311, 312 are also formed between two pairs of rollers 307 and 305. The first sheet transport path 312 includes a pair of rollers 316 and the second sheet transport path 311 includes a pair of rollers 315. These sheet transport paths 311 and 312 branch off after the pair of rollers 305 at an entrance and merge with each other at the pair of rollers 307 at an exit. Furthermore, a path selector 314 is set up at the junction point between the first sheet transport path 312 and the second sheet transport path 311.

Referring to FIG. 2(*a*), the finisher system inserts a first sheet 310*a* to the pair of rollers 305 through the sheet guide 308 from an image forming apparatus. The path selector 314 selects the second sheet transport path 311. The inserted first sheet 310*a* is thereby transported to the second sheet transport path 311 via the path selector 314 by rotation of the pair of rollers 305.

Referring to FIG. 2(*b*), while the inserted first sheet 310*a* is passing through the second sheet transport path 311, the path selector 314 shifts its position to select the first sheet transport path 312. The pair of rollers 305 then guides a second sheet 310*b* to the first sheet transport path 312.

Referring to FIG. 2(*c*), both sheets 310*a* and 310*b* are joined and piled at the entrance to the pair of feeding rollers 307 along each sheet transport path 311 and 312 because each path has a different distance. Simultaneously, the path selector 314 shifts its position to again select the second sheet transport path 311. A third sheet 310*c* is then fed to the second sheet transport path 311 by way of the path selector 314 by rotation of the pair of rollers 305.

Referring to FIG. 2(*d*), the first sheet 310*a* and the second sheet 310*b* are transported at this time. Furthermore, the path selector 314 then shifts its position to select the first sheet transport path 312. A fourth sheet 310*d* is then fed to the first sheet transport path 312 by way of the path selector 314 by rotation of the pair of rollers 305 while the third sheet 310*c* is transported in the second sheet transport path 311.

Now referring to FIG. 3, another background art system is disclosed in Japanese Laid Open patent application 5-147372, U.S. Pat. No. 5,344,130. In this background art, a finisher 440 receives a first sheet S1 and transports the first sheet S1 along a main path 441*c* during a finishing operation for a first set of sheets S on a finishing plate 446, for example to be stapled by a stapler 449, as shown in FIG. 3(*a*). Then, the finisher 440 suspends rotating of a pair of rollers 443 during the finishing operation for the first set of sheets. As a result of suspending rotating of the pair of rollers 443, the sheet S1 is also suspended at the pair of rollers 443.

Referring to FIG. 3(*b*), a second sheet S2 is transported along a bypath 441*b* by shifting a deflector 444. As a result, the finisher 440 is capable of maintaining a time of a finishing time for the first set of sheets S. Sequentially, after the finisher 440 completes the finishing operation for the first set of sheets, the pair of rollers 442 and 443 is synchronously rotated. Finally, sheets S1 and S2 are simultaneously fed from main path 441*c* and bypath 441*b* to the finishing plate 446 as shown in FIG. 3(*c*).

The inventor of the present invention has identified that the above background art systems have the following problems. In the background art system of FIGS. 1 and 2, when the finisher system transports the both sheets 310*a*, 310*b*, these sheets may reach roller pair 307 with a shifted position (i.e., the first shift 310*a* may be shifted upstream and reach roller pair 307 prior to second sheet 310*b*) in a transporting direction toward the sheet transport paths. As a result, the both sheets 310*a*, 310*b* are joined and piled with a shifted position in the transporting direction at roller pair 307. This sheet transportation with the shifted position may cause of a sheet jam and improper stacking at a finisher. The finisher then may not be capable of carrying out a proper finishing operation.

Furthermore, in the background art system of FIG. 3 the sheets ejected from the pair of rollers 442 and 443 fall on account of their own weights. Therefore, when the finisher system transports the both sheets S1, S2 with a shifted position in a transporting direction toward the sheet transport paths, the finisher may not be capable of carrying out a proper finishing operation. The both sheets S1, S2 are joined and piled at the pair of rollers 442 and 443. Therefore, when the sheets S1, S2 have shifted in the transport direction on the finishing plate 446, the sheets are transported just at a shifted position.

SUMMARY OF THE INVENTION

The present invention has aspects to overcome the above problems encountered in the aforementioned art.

Furthermore, Accordingly, one object of the present invention is to provide a finishing system for an image forming apparatus which can maximize an efficiency of operations.

A more specific object of the present invention is to provide a finishing system for an image forming apparatus which can ensure proper feeding of sheets to a finisher while minimizing operation time.

In one embodiment, the present invention achieves these objectives by providing a finishing system for image formed sheets transported from an image forming apparatus which includes a finisher for finishing the image formed sheets, a direct sheet feeding path for feeding the image formed sheets to a sheet stacker, a sheet finishing path branched from the direct sheet path for transporting the image formed sheets to the sheet stacker by way of the finisher, and a sheet piling system set upstream from a turning point at which the sheet finishing path branches from the direct feeding path for piling up the image formed sheets.

As a further feature of the present invention, a stopper can be set upstream from the turning path to temporarily trap the image formed sheets, and the stopper can take the form of a pair of independently driven rollers or a plate.

As a further feature of the present invention, the sheet piling system may include plural paths located at different locations.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 16:
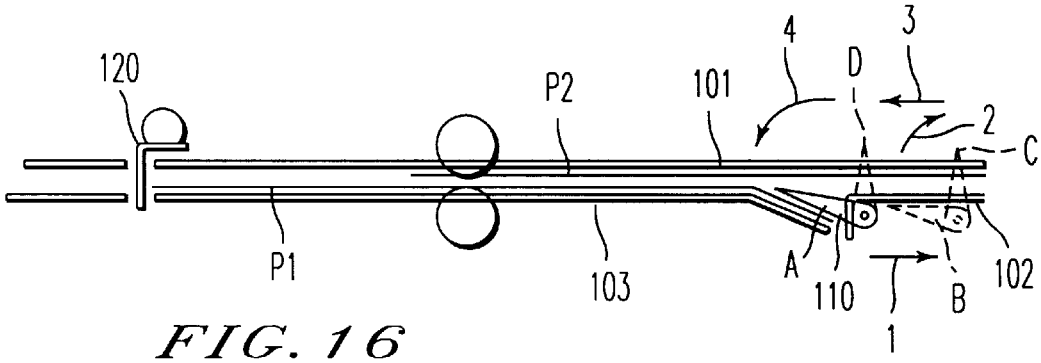
FIG. 16 is a cross sectional view of a further embodiment of a sheet piling device of a finisher system according to the present invention.
Figure 1:
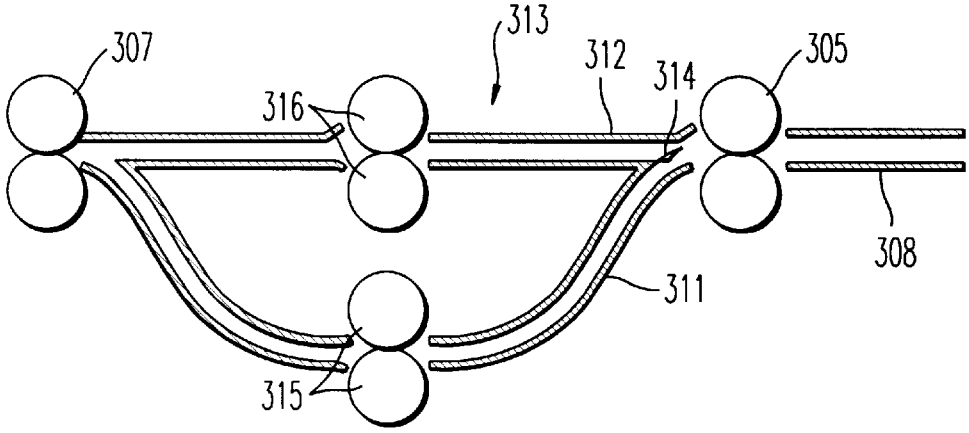
FIG. 1 BACKGROUND ART
FIG. 1 is a cross-sectional view of a background sheet transport system including a finisher.
Figure 2A:
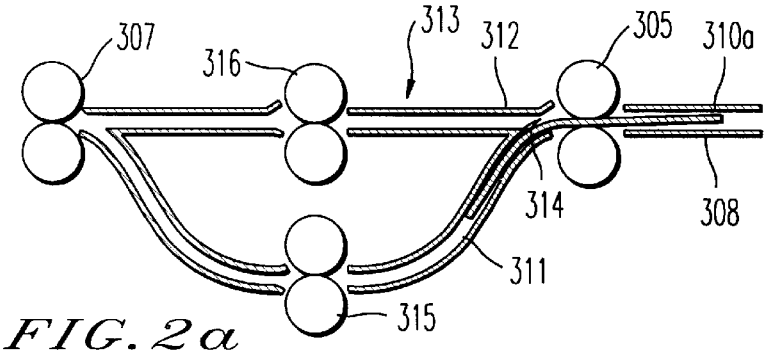
FIG. 2a BACKGROUND ART
FIGS. 2(*a*)–2(*d*) are sequential cross-sectional views of the background sheet transport system with finisher of FIG. 1.
Figure 2B:
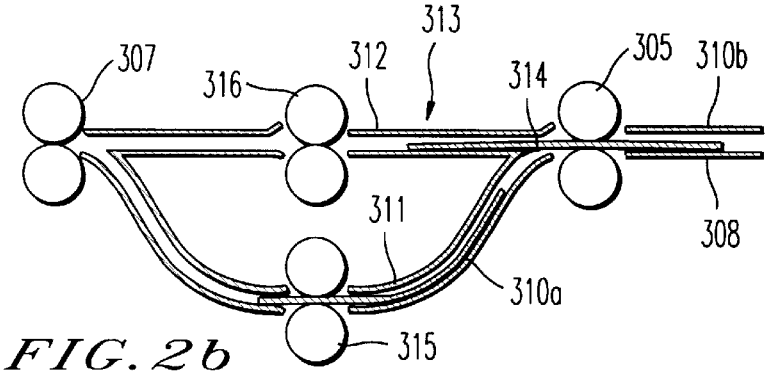
FIG. 2b BACKGROUND ART
Figure 2C:
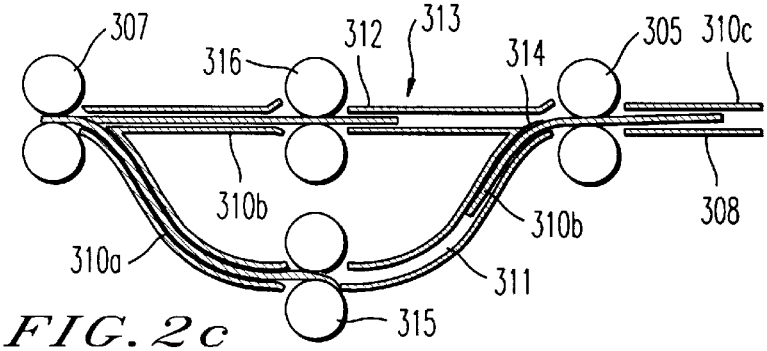
FIG. 2c BACKGROUND ART
Figure 2D:
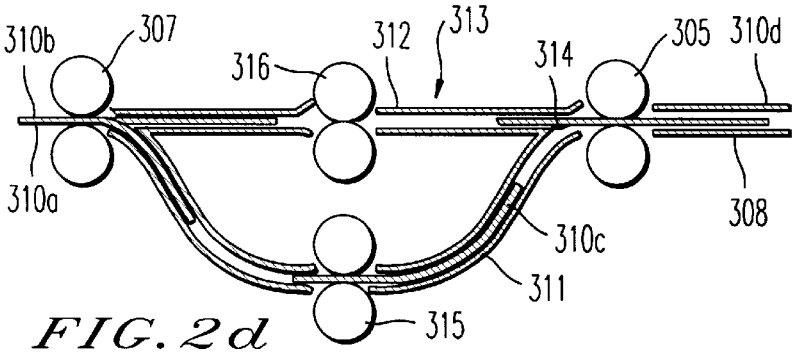
FIG. 2d BACKGROUND ART
Figure 3A:
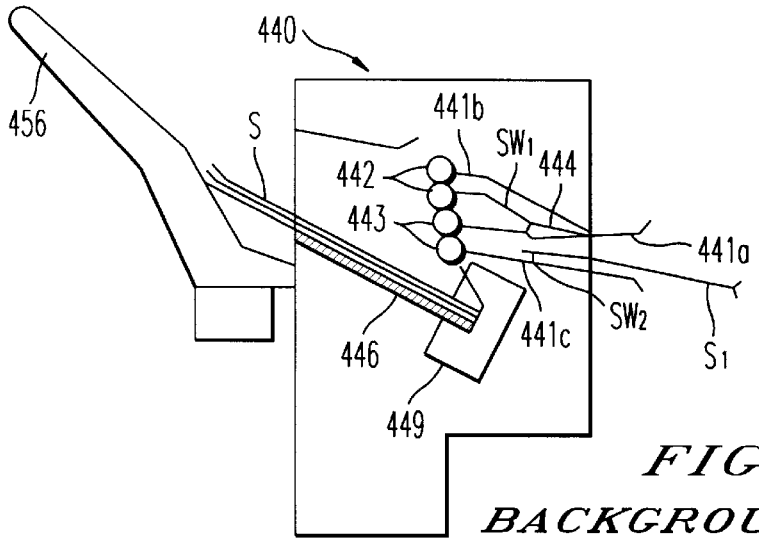
FIG. 3a BACKGROUND ART
FIGS. 3(*a*)–3(*c*) are cross-sectional views of another background finisher system.
Figure 3B:
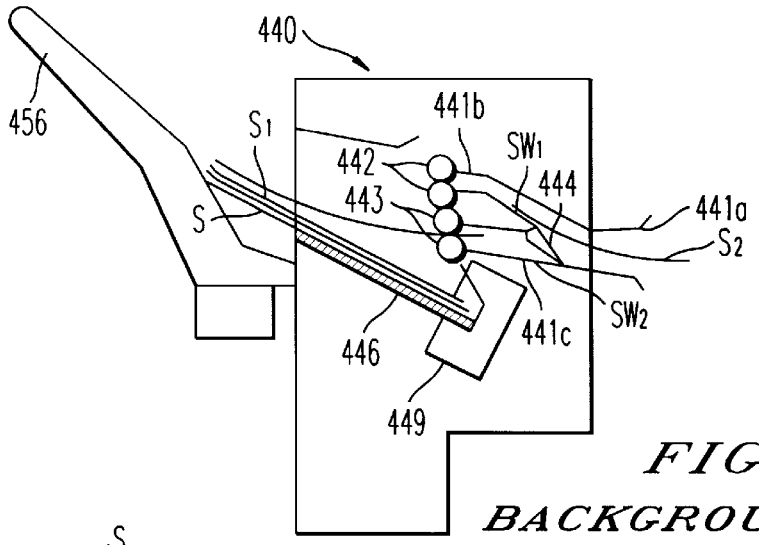
FIG. 3b BACKGROUND ART
Figure 3C:
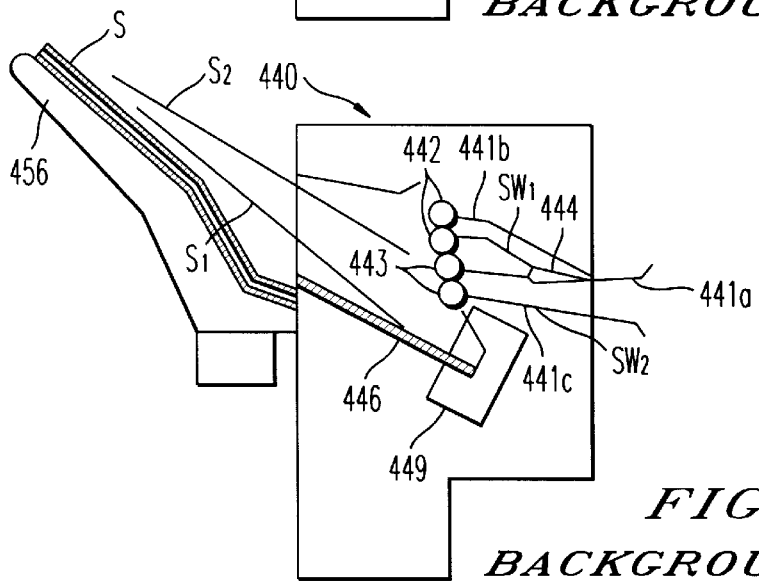
FIG. 3c BACKGROUND ART

A description will now be given of preferred embodiments according to the present invention, in which like reference numerals designate identical or corresponding parts throughout the views.

Figure 4:
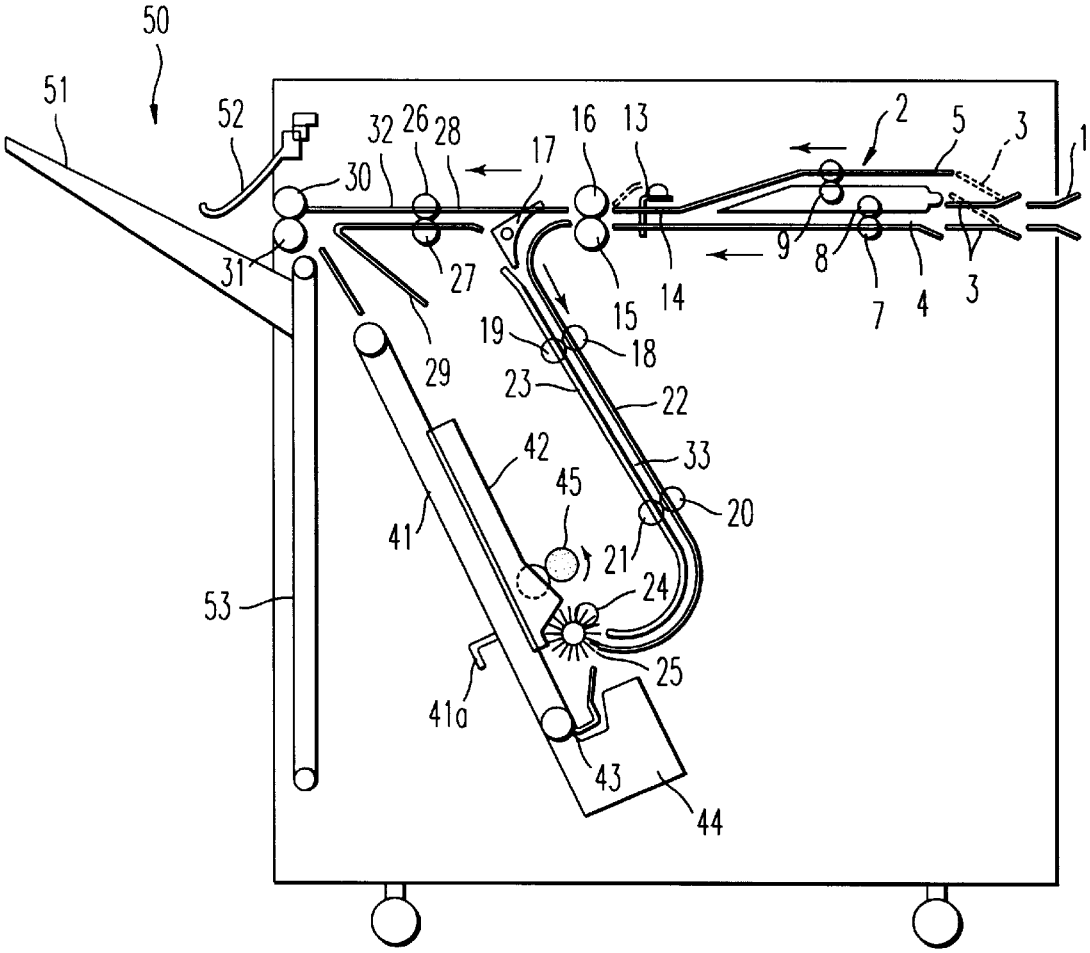
FIG. 4 is a cross sectional view of a first embodiment of a finisher system according to the present invention.

Referring to FIG. 4, a finisher system of the present invention includes an image formed sheet receiver 1, a sheet piling device 2, a direct sheet feeding path 32, a finishing sheet path 33, a finisher 40 along the finishing sheet path 33, and a finished sheet stacker 50.

The image formed sheet receiver 1 receives image formed sheets from an image forming apparatus. The image forming apparatus can be an image forming system which forms images on sheets, for example by electrophotography, thermal printing, ink jet printing, etc. The image formed sheet receiver 1 guides the image formed sheets along its guides to the finisher system 40. A piling path selector 3 is located at an exit of the image formed sheet receiver 1 in the sheet transport direction. The piling path selector 3 alternatively guides each sheet to a first sheet piling path 4 and then a second sheet piling path 5. The sheet piling path 4 includes a drive roller 7 and a pressure roller 8 which transport a fed sheet in the sheet transport direction as shown by an arrow. The sheet piling path 5 also includes a drive roller 9 and a pressure roller 10 which transport a fed sheet in the sheet transport direction as also shown by an arrow.

A radius of the drive roller 7 in the sheet piling path 4 can be set to be smaller than that of the drive roller 9 in the sheet piling path 5. Therefore, a transport speed in the sheet piling path 5 is faster than that in the sheet piling path 4. Sheets are transported by the drive roller 7 and pressure roller 8 in the sheet piling path 4, and also by the drive roller 9 and pressure roller 10 in the sheet piling path 5.

Subsequently, sheets fed through the sheet piling paths 4 and 5 are joined at a downstream point in the sheet piling device 2. Therefore, the sheets are piled up at a confluence point of the sheet piling path 4 and the sheet piling path 5. A stopper 13, which may be of a plate form, is set up immediately after this confluence point in the sheet path 14. The stopper 13 is capable of selectably moving from positions where paper sheets are released and trapped. A detail of the stopper 13 is described later. A pair of rollers 15 and 16 is also arranged at a downstream point of the sheet path 14 in order to transport the sheets along the sheet transport direction. The rollers 15 and 16 can be driven at a same speed. Therefore, the sheets transported by the pair of rollers 15 and 16 do not shift in the sheet transporting direction. However, the sheet from the sheet piling path 5 can be advanced, i.e., leading, relative to the sheet from the sheet piling path 4 in the sheet transport direction as a result of the difference in rotational speeds (as a result of the difference in radius) of the rollers 7 and 9, as though the sheets were shifted at the pair of rollers 15 and 16.

Furthermore, a sheet path selector 17 is arranged downstream from the pair of rollers 15 and 16. The sheet path selector 17 selectably rotates between a position that guides sheets into the direct sheet feeding path 32 and guides sheets into the finishing sheet path 33. A confluence point of the direct sheet feeding path 32 and the finishing sheet path 33 is located at the sheet path selector 17.

The direct feeding sheet path 32 includes a guide plate 28, a pair of transport rollers 26 and 27, and sheet feeding rollers 30 and 31. The guide plate 28 guides the sheets from the sheet path selector 17 to a sheet stacker 50. The pair of transport rollers 26 and 27 transport the sheets along the direct feeding sheet path 32. The sheet feeding rollers 30 and 31 eject sheets to the sheet stacker 50.

On the other hand, the finishing sheet path 33 includes guide plates 22 and 23, two pairs of rollers 18, 19 and 20, 21, and eject rollers 24, 25. The guide plates 22 and 23 guide sheets to the finisher 40 along the finishing sheet path 33. The two pairs of rollers 18, 19 and 20, 21 transport sheets along the finishing sheet path 33. The eject rollers 24 and 25 eject sheets onto the finisher tray 44 of the finisher 40. The eject roller 25 has its surface brushed.

The finisher 40 additionally includes a pair of side fences 42 and end fences 43. The pair of side fences 42 adjusts the sides of a set of sheets perpendicular to the sheet transport direction. The end fences 43 adjust an end face of a set of sheets by the brush during rotation of the eject roller 25. Each sheet, or each set of sheets, is adjusted mutually in their sheet transport direction and in their vertical direction by the side fences 42 and the end fences 43. Then, the sheets can be finished, e.g., stapled, by finisher 40.

Furthermore, the finisher 40 includes an eject belt 41 which ejects a finished sheet or set of sheets to the sheet stacker 50. A hook 41*a* formed on the eject belt 41 is rotated with the rotation of the eject belt 41. The hook 41*a* hooks the finished sheets during its rotation, e.g., counterclockwise, and ejects the sheets to the sheet stacker 50 via the eject rollers 30 and 31.

The sheet stacker 50 includes a tray 51, a sheet detect filler 52 and stacker shift device 53. The tray 51 stacks ejected sheets. The sheet detect filler 52 detects the stacked sheets on the tray 51. If the sheet detect filler 52 contacts a top of the sheet stack, the stacker shift device 53 shifts downward.

Figure 5A:
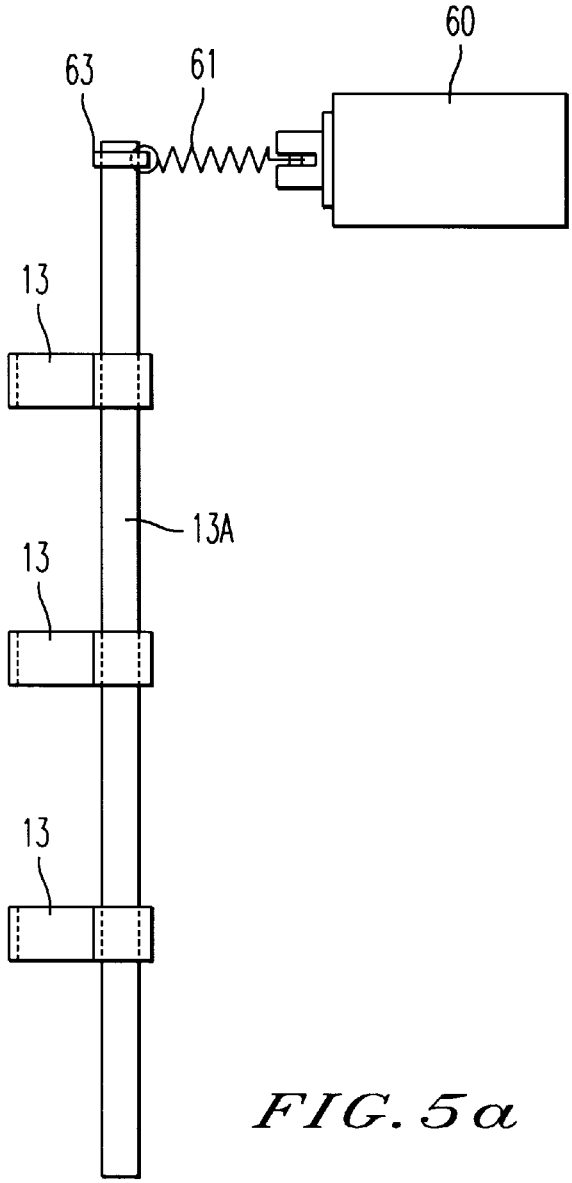
FIGS. 5(*a*) and 5(*b*) are top and side cross-sectional views of a stopper system with a suspending position in the first embodiment according to the present invention.
Figure 5B:
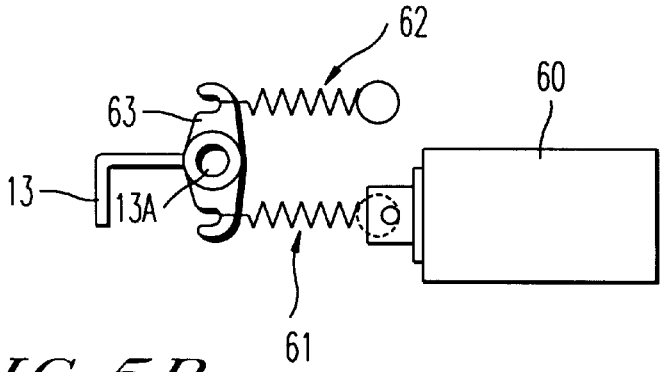

Now referring to FIGS. 5(*a*) and 5(*b*), details of the stopper 13 are shown. The stopper 13 is arranged on a shaft 13A in a vertical direction of a sheet transport direction. One side of the shaft 13A secures a hook 63. One side of the hook 63 is connected to a solenoid actuator 60 via a spring 61 and another side is fixed via spring 62. When the solenoid 60 retracts a tip of its shaft, one side of the hook 63 is pulled by the power of the spring 61. Then, the stopper 13 secures a sheet in a suspended position according to a rotation around the axis of the shaft 13A.

Figure 6A:
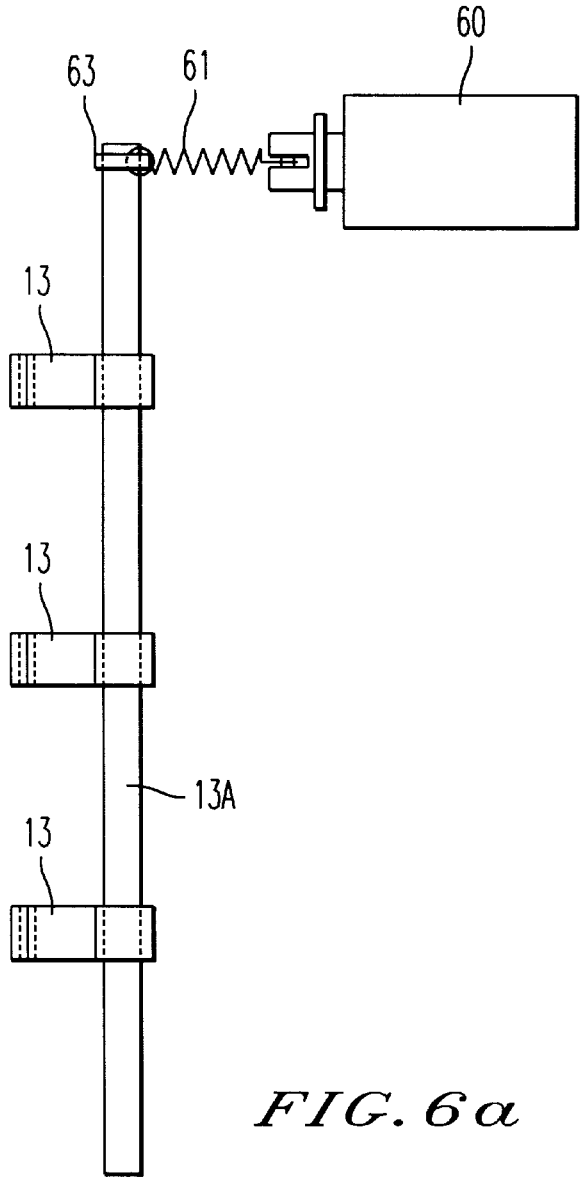
FIGS. 6(*a*) and 6(*b*) are top and side cross-sectional view of a stopper system with a releasing position in the first embodiment according to the present invention.
Figure 6B:
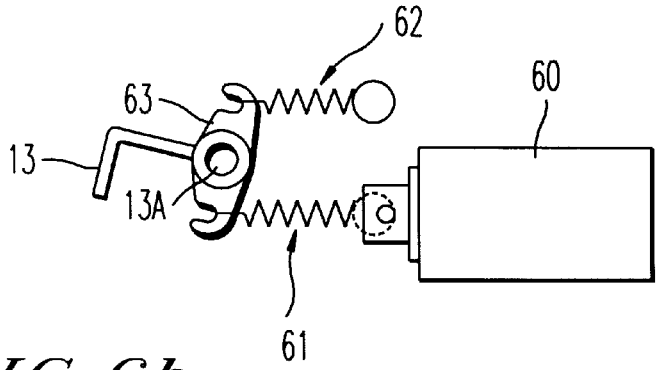

Referring to FIGS. 6(*a*) and 6(*b*), when the solenoid 60 extends the tip of its shaft, another side of the hook 63 is pulled by the power of the spring 62. Then, the stopper 13 is secured in a sheet release position according to a rotation around the axis of the shaft 13A.

Figure 7:
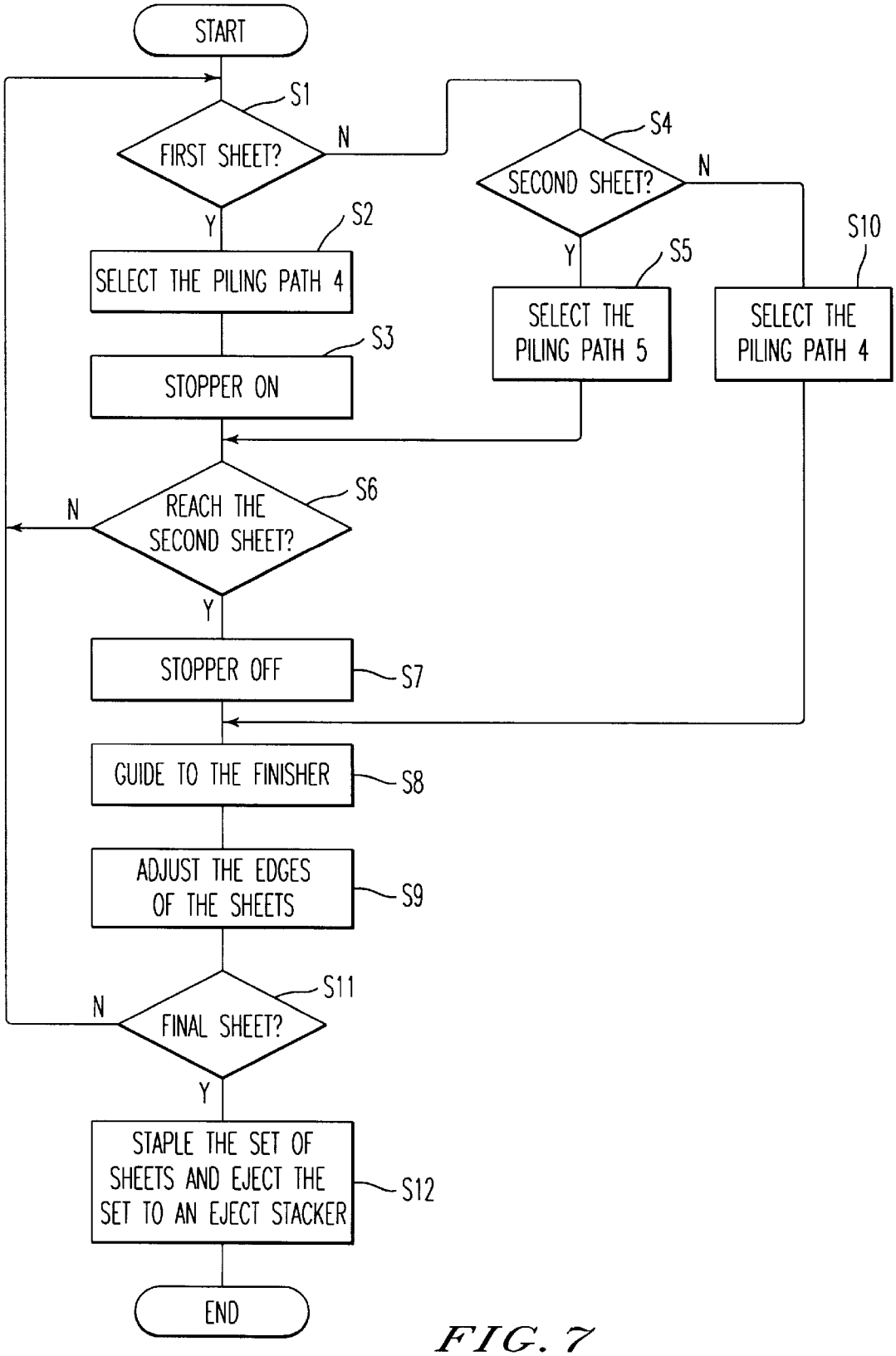
FIG. 7 is a flow chart illustrating steps involved in a first process performed by a sheet piling operation according to the present invention.

Now referring to FIG. 7, when the finisher system receives a sheet, the system detects whether the sheet is a first sheet or not in a step S1. In step S1, when the received sheet is the first sheet, the operation proceeds to a step S2. On the other hand, in step S1, when the received sheet is not the first sheet, the operation proceeds to step S4.

In step S2, the sheet piling path 4 is selected. The first sheet is then trapped in the sheet piling path 4 in step S3 by closing stopper 13 and the operation then proceeds to a step S6. A second sheet is then trapped in the sheet piling path in step S6. If the second sheet is not trapped, NO in step S6, the operation returns to step S1. If the second sheet is trapped, YES in step S6, the operation proceeds to step S7. In a case that the second sheet does not reach the finisher system and the first sheet is suspended in step S6, the operation proceeds to step S4 by way of step S1. When the second sheet is received in the finisher system in step S4, the sheet piling path 5 is selected and the second sheet is trapped in the sheet piling path 5 by the stopper 13 in a step S5. Thus, in step S6 the operation confirms suspension of the second sheet in the piling path 5.

In a step S7 the stopper 13 then releases both sheets at the instant when the second sheet is suspended. A finishing sheet path can then be selected and the released sheets are thereby transported to the finisher 40 along the finishing sheet path 33 in a step S8. When the sheets reach the finisher 40, the edges of the sheets are adjusted at the finisher in a step S9. In a step S11, the operation confirms whether a sheet is a final sheet or not. When a sheet is not the final sheet, the operation returns to step S1. When the received sheet is a third sheet, the sheet path is selected to the piling sheet path 4 again in a step S10. After the third sheet is transported in the finisher system, the stopper 13 is always opens. Finally, when the received sheet is the final sheet in a step S11, the final sheet is transported to the finisher and is finished, e.g. stapled, in a step S12. Still in step S12, the finished set of sheets is ejected to the sheet stacker 50. In step S9, the adjusting roller 25 can always rotate to adjust the last sheet of the set of sheets. When the adjustment of the last sheet is completed, the adjusting roller 25 slips with the last sheet.

Furthermore, the finisher system also carries out the same operation on a second and further set of sheets. Therefore, the finisher system has an interval time between the ejection of a last sheet of a first set of sheets to the ejection of two piled sheets of a second set of sheets. The finisher system is capable of carrying out a finishing operation during the above interval time.

With the operation of the present invention as discussed above, the first and second sheets can have their edges aligned by both being stopped at the stopper 13. Therefore, these first and second sheets can be fed at a same leading edge position to the finisher 40, which operation can ensure proper feeding of these first and second sheets. As noted above, this operation is then further performed on the following sheets.

Also as noted above, a radius of the drive roller 7 in the sheet piling path 4 can be set to be smaller than that of the drive roller 9 in the sheet piling path 5. In this operation, a transport speed in the sheet piling path 5 may be faster than that in the sheet piling path 4, and thereby a second fed sheet will have a leading edge which slightly precedes that of the first fed sheet.

This operation of the present invention of allowing the second sheet to slightly precede the first sheet provides a further benefit in the present invention of ensuring more proper stacking of the sheets at the finisher 40. More particularly, if a first sheet was to slightly precede a second sheet, when the first and second sheets are fed to the finisher 40, the brush roller 25 will only contact the outermost sheet, which in this instance would be the second sheet. If the first sheet slightly preceded the second sheet in this instance only the second sheet will be contacted by the roller 25 and the first sheet may then not be properly aligned with the roller 25 as the roller 25 will not be able to contact the first sheet to properly position the first sheet. However, as noted above one of the further features of the present invention is that the second sheet can be transported to slightly precede the first sheet. With such an operation, the roller 25 can properly position both sheets as the roller 25 will be able to property contact the sheets.

Therefore, as noted above the finisher system can transport the second sheet to precede the first sheet to the finisher 40. Thereupon, the first sheet of each set of sheets each time initially contacts the end fence 43 of the finisher 40. The adjusting roller 25 can then contact and adjust the second sheet. Therefore, the end side of the set of sheets is adjusted in the finisher 40.

Furthermore, if the radius of the drive roller 7 is equal to that of the drive roller 9, the finisher system is capable of transporting the second sheet to precede the first sheet by the finisher system changing the rotation speed of the drive roller 7 to be greater that of the drive roller 9.

In the first embodiment, the sheet piling device 2 piles two sheets. The sheet piling device 2 is also capable of having n piling paths. When the sheet piling device 2 has n piling paths, the sheet piling system 2 is capable of piling sheets.

Figure 8:
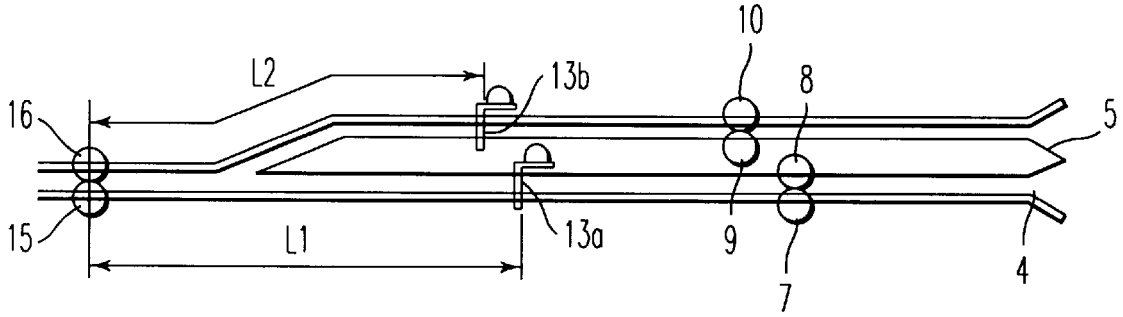
FIG. 8 is a cross-sectional view of a second embodiment of a sheet piling device of a finisher system according to the present invention.

Referring now to FIG. 8, the sheet piling system can include stoppers two 13*a* and 13*b* in each piling path 4 and 5 in a further embodiment, instead of including only one stopper 13 in the embodiment of FIG. 4. In this further embodiment an explanation of the devices and portions explained above are omitted.

The sheet guide 3 guides the first sheet from the image forming apparatus in the piling path 4. The stopper 13*a* is located at a sheet trap position by rotation about an axis of its shaft and traps the transported first sheet in the piling sheet path 4. When the second sheet is transported in the piling device 2 from the image forming apparatus, the sheet guide 3 guides the second sheet to the piling path 5. The stopper 13*b* is located at a sheet trap position by rotation about an axis of its shaft and traps the transported second sheet in the piling sheet path 5. When the second sheet reaches the stopper 13*b*, both stoppers 13*a* and 13*b* are opened and the trapped sheets are then released from the stoppers 13*a* and 13*b* instantaneously. The both released sheets are then joined and are piled up upstream at the pair of rollers 15 and 16.

In this further embodiment, if the radius of the drive roller 7 is equal to that of the drive roller 9, the finisher system is capable of transporting the second sheet to precede the first sheet by the finisher system changing the rotation speed of the drive roller 7 relative to that of the drive roller 9. Furthermore, when the rotation speed of both rollers 7, 9 is equal, the finisher system is also capable of changing a distance of the piling path 4 relative to that of the first piling path 5. When the distance (L1) between the stopper 13*a* and the pair of rollers 15, 16 is longer than the distance (L2) between the stopper 13*b* and the pair of rollers 15, 16, the piled sheets are transported with shifted sheet positions such that the second sheet precedes the first sheet. As noted above, this can provide the benefit that the sheets are properly stacked at finisher 40.

Still furthermore, when a release timing of the stopper 13*b* is a little faster than that of the stopper 13*a*, the finisher system is capable of transporting the sheets with a shifted sheet position in which the second sheet precedes the first sheet to the finisher system even if the above distances are equal.

Figure 9:
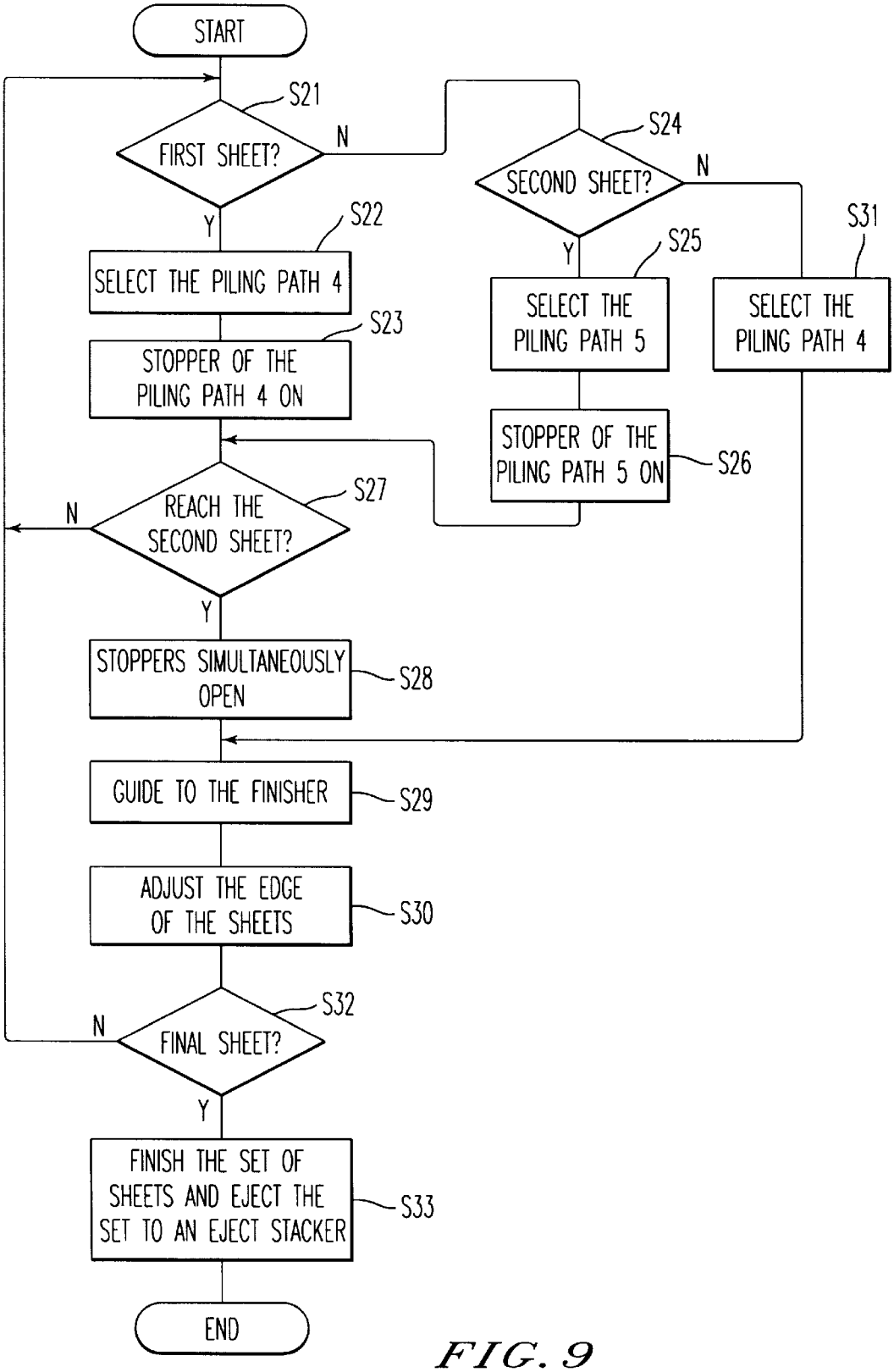
FIG. 9 is a flow chart illustrating steps involved in a second process performed by a sheet piling operation according to the present invention.

Referring to FIG. 9, an operation in this further embodiment of FIG. 8 is explained. In FIG. 9 when the finisher system receives a sheet, the system detects whether the sheet is a first sheet or not in a step S21. In step S21, when the received sheet is the first sheet the operation proceeds to a step S22. On the other hand, in step S21 when the received sheet is not the first sheet, the operation proceed to a step S24. The piling path 4 is then selected in the step S22. The first sheet is also trapped in the sheet piling path 4 by the stopper 13*a* in step S23, and the operation then proceeds to a step S27. If the second sheet is not trapped in step S27, the operation returns to step S21. If the second sheet is trapped in step S27, the operation proceeds to a step S28. In a case that the second sheet does not reach the finisher system and only the first sheet is trapped, the operation proceeds to a step S24 by way of step S21. When the second sheet is received in the finisher system in step S24, the sheet piling path 5 is selected in a step S25, and the second sheet is then trapped in the sheet piling path 5 by the stopper 13*b* in a step S26.

In the step S27, the operation confirms a suspension of the second sheet in the piling path 5. When the second sheet is trapped, both stoppers 13*a* and 13*b* release the both sheets simultaneously in a step S28. A finishing sheet path is selected and the released sheets are then transported to a finisher along a finishing sheet path in a step S29. When the sheets reach the finisher, the edges of the sheets are adjusted at the finisher in a step S30.

In a step S32, the operation confirms whether a sheet is the fmal sheet or not. When a sheet is not the final sheet, NO in step S32, the operation returns to step S21. Furthermore, when the received sheet is a third or further sheet, the sheet path is selected to the piling sheet path 4 again in a step S31. After the third sheet is transported in the finisher system, the stopper 13*b* is always opened. Finally, when the received sheet is the final sheet, YES in step S32, the final sheet is transported to the finisher and the sheets are finished, e.g. stapled, in a step S33. Still in the step S33, the finished stack of sheets is ejected to sheet stacker 50. In the step S30, the adjusting roller 25 always rotates to adjust the last sheet of the set of sheets. When the adjustment of the last sheet is completed, the adjusting roller 25 slips with the last sheet. The finisher system also carries out the same operation on further sets of sheets.

In this further embodiment, the finisher system has a time interval between the ejection of the final sheet of a first set of sheets and the ejection of two piled sheets of a second set of sheets. The finisher system can thereby carry out a finishing operation during the above interval time. The finisher system can also transport the second sheet to precede the first sheet to the finisher so that the first sheet contacts the end fences 43 in the finisher 40 at first. The adjusting roller 25 then properly contacts and adjusts the second sheet. Therefore, the end edges of the sheets are adjusted and properly aligned in the finisher 40.

Furthermore, if the radius of the drive roller 7 is equal to that of the drive roller 9, the finisher system is capable of transporting the second sheet to precede the first sheet to the finisher system by changing the rotation speed of the drive roller 7 to be greater than that of the drive roller 9. In the further embodiment, the sheet piling system 2 piles two sheets. When the sheet piling system 2 has n piling paths over two paths, the sheet piling system 2 can pile n sheets. Still furthermore, the finisher system is capable of transporting the second sheet at a same position of an end edge as the first sheet by controlling the positioning and releasing of the stoppers 13*a*, 13*b*.

Figure 10:
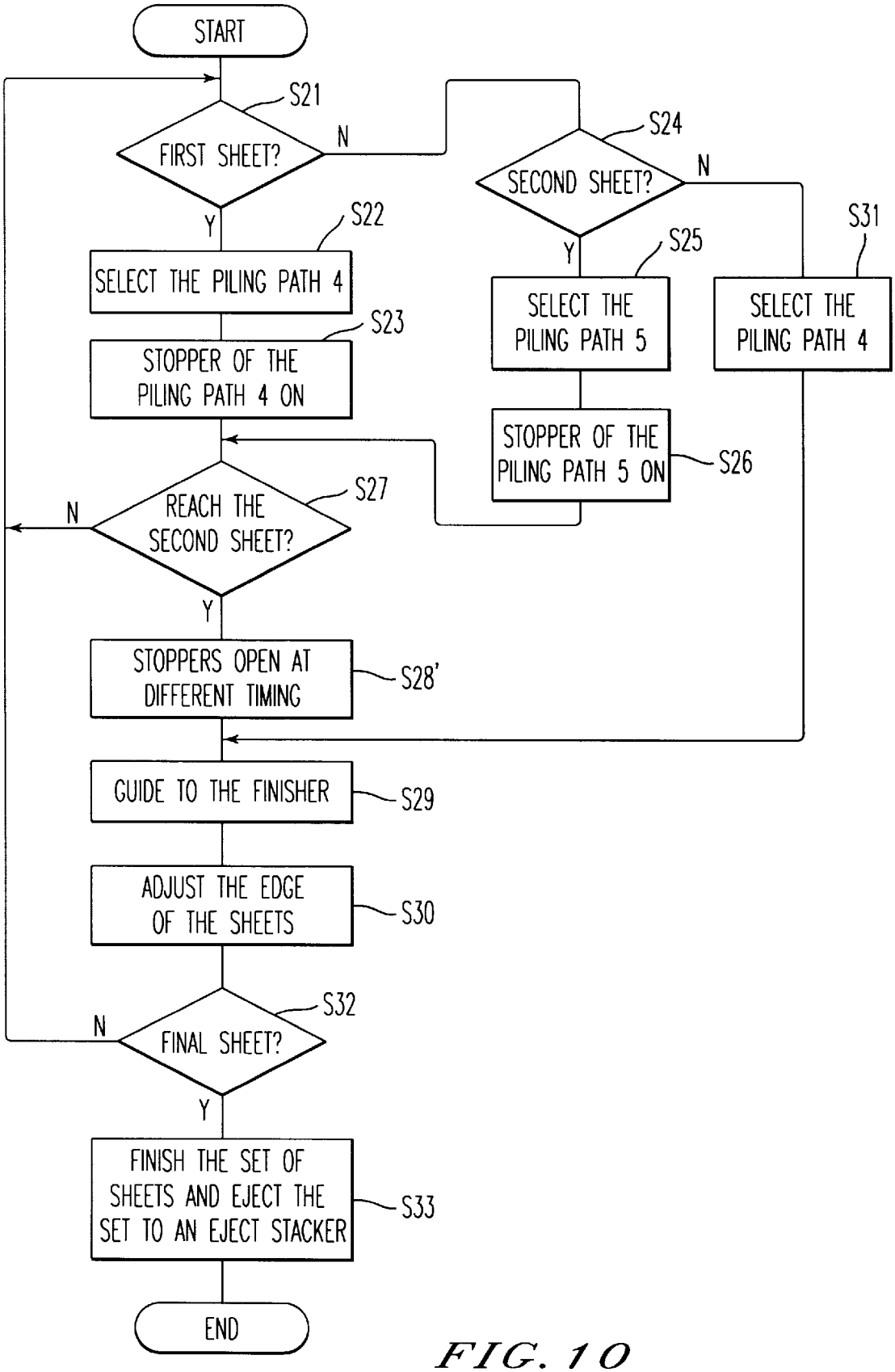
FIG. 10 is a flow chart illustrating steps involved in a third process performed by a sheet piling operation according to the present invention.

Now referring to FIG. 10, a further operation in the present invention for the system of FIG. 8 is explained. In FIG. 10 when the finisher system receives a sheet, the system detects whether the sheet is a first sheet or not in a step S21. In step S21 when the received sheet is the first sheet, the operation proceeds to a step S22. On the other hand, in step S21 when the received sheet is not the first sheet, the operation proceeds to a step S24. The piling path 4 is then selected in step S22. The first sheet is then trapped in the sheet piling path 4 by the stopper 13*a* in step S23, and the operation then proceeds to a step S27. If the second sheet is not trapped in step S27, the operation returns to step S21. When the second sheet reaches the finisher system in step S27, the operation proceeds to a step S28'. In a case that the second sheet does not reach the finisher and the first sheet is trapped, the operation proceeds to a step S24 by way of step S21. When the second sheet is received in the finisher system in step S24, the sheet piling path 5 is selected in a step S25, and the second sheet is then trapped in the sheet piling path 5 by the stopper 13*b* in a step S26.

In step S27, the operation confirms a suspension of the second sheet in the piling path 5. When the second sheet is trapped, both stoppers 13*a* and 13*b* release the both sheets with different timings in a step S28'. A finishing sheet path is selected and the released set of sheets is transported to the finisher 40 along a finishing sheet path in a step S29. When the set of sheets reaches the finisher 40, the edge of the set of sheets is adjusted at the finisher 40 in a step S30.

In a step S32, the operation confirms whether a sheet is a final sheet or not. When a sheet is not the final sheet, NO in step S32, the operation returns to step S21. Furthermore, when the received sheet is a third or further sheet, the sheet path is selected to the piling sheet path 4 again in a step S31. After the third sheet is transported in the finisher system, the stoppers 13 are always open. Finally, when the received sheet is the final sheet in step S32, the final sheet is transported to the finisher and the set of sheets is stapled in a step S33. Also, in step S33, the set of sheets is ejected to sheet stacker 50. In step 30, the adjusting roller 25 always rotates to adjust the last sheet of the set of sheets. When the adjustment of the last sheet is completed, the adjusting roller 25 slips with the last sheet. The finisher system also carries out the same operation on a second and later sets of sheets.

In the above discussed embodiments, the stopper(s) 13 or 13*a* and 13*b* trap(s) the piling sheets in the sheet piling device 2. However, as an alternative, the pair of rollers 15 and 16 is capable of trapping the piling sheets without utilizing a stopper. The pair of rollers 15 and 16 can have a driver which differs from the driver of other rollers. The received first sheet can then be guided to the piling sheet path 4 and trapped by the pair of rollers 15 and 16 because driving of the pair of rollers 15 and 16 can be suspended by their own driver. Sequentially, when the second sheet is received in the sheet piling device 2, the piling sheet path selector 3 selects the sheet piling path 5 and the received second sheet is guided in the sheet piling path 5 until it reaches the pair of rollers 15 and 16. The second sheet can then be piled with the first sheet upstream of the pair of rollers 15 and 16. The pair of rollers 15 and 16 can then be rotated by their own driver at the instant when the second sheet reaches the pair of rollers 15 and 16. Thereby, a finisher system without a stopper is capable of transporting a set of sheets with piling each sheet to the finisher because the driver of the pair of rollers 15 and 16 rotates the sheets at the instant when the second sheet reaches the nip portion in a situation that the pair of rollers 15 and 16 has nipped the first sheet. A second sheet is then shifted to be upstream of a first sheet in the sheet piling device 2, or the first and second sheets can be transported with their edges aligned.

Figure 11A:
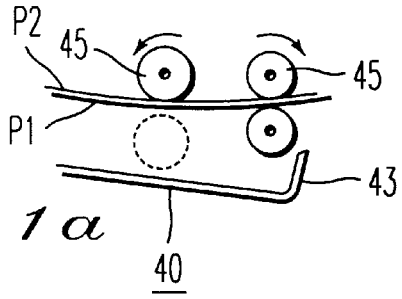
FIGS. 11(*a*) and 11(*b*) are cross-sectional views of a sheet edge adjustment mechanism according to the present invention.
Figure 11B:
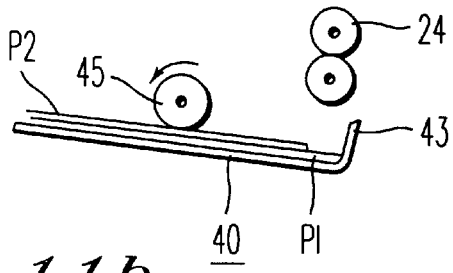

Now referring to FIG. 11, a further embodiment of the present invention is explained. In FIGS. 11(*a*), 11(*b*) when the finisher adjusts an end edge of a set of sheets, a standard position of the end edge of the set of sheets exists upstream of the adjusting roller 45 in the sheet transport direction. When a set of sheets P1 and P2 is transported to a tray 3 of a finisher 40, a pair of eject rollers 24 ejects the sets of sheets P1 and P2.

In the finisher system as shown in FIG. 4, the set of sheets is ejected in a position that a first sheet is piled in a side of the tray 43 of the finisher toward a second sheet by way of the piling device 2. The second sheet P2 can precede the first sheet P1 in a transporting direction. Furthermore, and as noted above, the second sheet P2 is on the side of the adjusting roller 45 toward the first sheet P1 in the tray 43. Therefore, the first sheet P1 is surely placed against the standard end of the tray 43. When the adjust roller 45 rotates in the direction as shown by an arrow, the adjust roller 45 is capable of adjusting the second sheet P2 which precedes the first sheet P1 in the sheet transport direction.

Figure 12A:
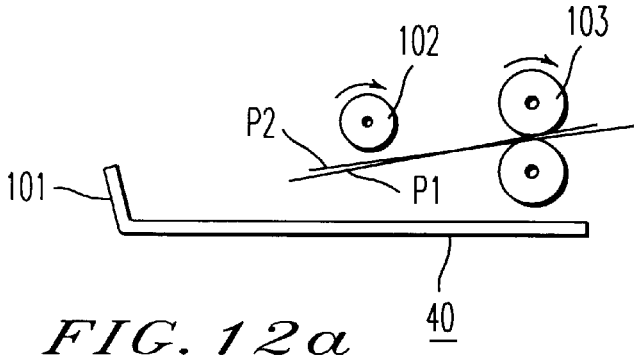
FIGS. 12(*a*) and 12(*b*) are cross-sectional views of another sheet adjustment mechanism according to the present invention.
Figure 12B:
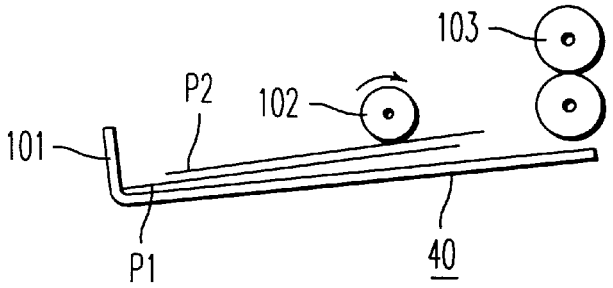

Now referring to FIGS. 12(*a*), 12(*b*), a further embodiment of the present invention is described. In FIGS. 12(*a*), 12(*b*) when the finisher adjusts the end edge of the set of sheets, a standard position of the end edge of the set of sheets is downstream of the adjusting roller 102 in the sheet transport direction. When sets of sheets P1 and P2 are transported to a tray 101 of a finisher, a pair of eject rollers 103 ejects the sets of sheets P1 and P2.

In the finisher system as shown FIG. 4, a set of sheets is ejected in a position that a first sheet is piled in the side of the tray 101 of the finisher toward a second sheet by way of the piling device 2. The second sheet P2 can precede the first sheet P1 in the transporting direction. Furthermore, the second sheet P2 is on the side of the adjusting roller 102 toward the first sheet P1 in the tray 101. Therefore, the first sheet P1 is surely placed against the standard end edge of the tray 101. When the adjust roller 102 rotates in the direction as shown by an arrow, the adjust roller 102 is capable of adjusting the second sheet P2 which preceded the first sheet P1 in the sheet transport direction.

The above adjust rollers 45 and 102 may be sponge rollers or a roller which has a similar function of a sponge roller. Furthermore, the finisher system can also utilize an adjust belt instead of an adjust roller 45 and 102.

Figure 13:
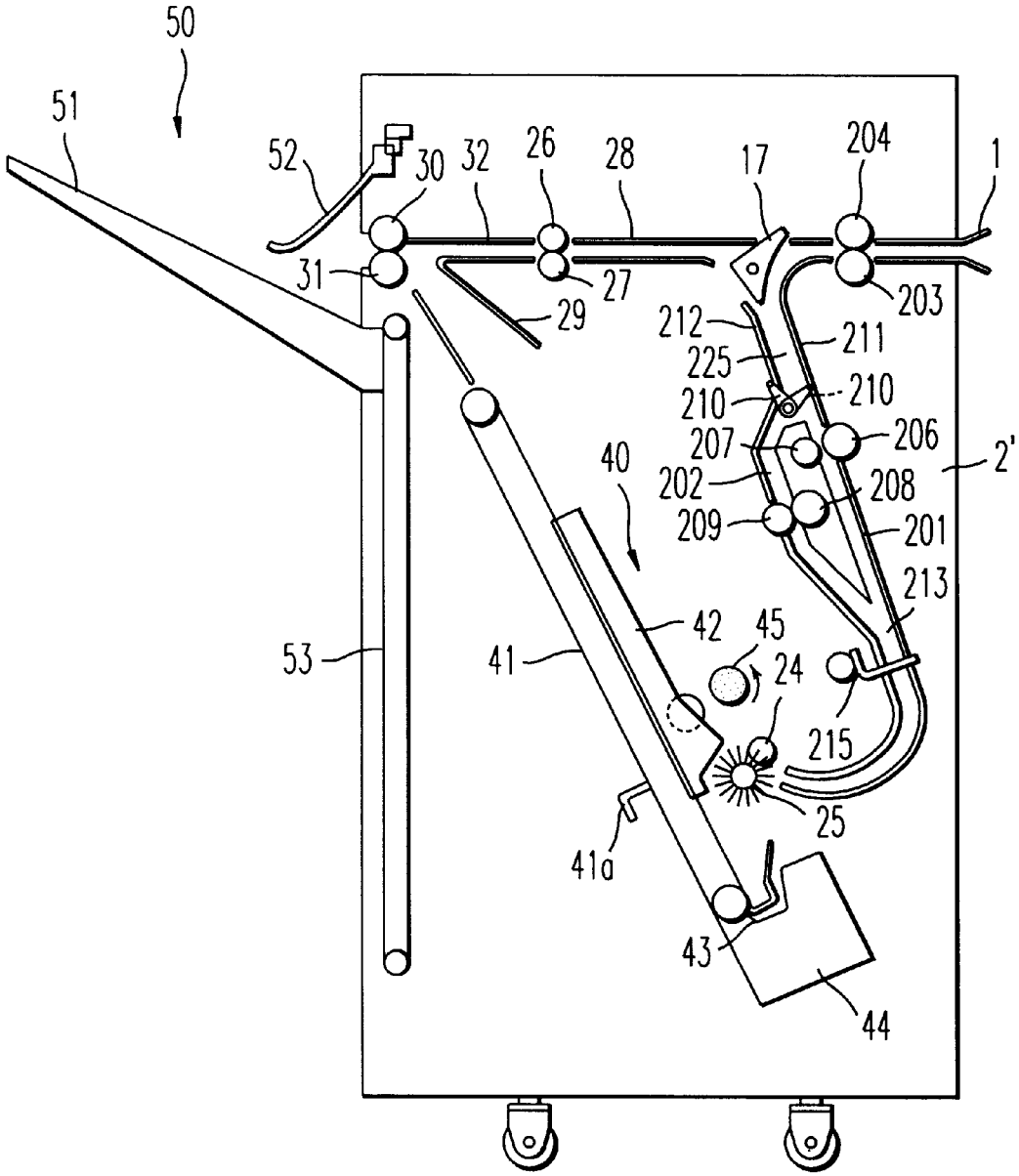
FIG. 13 is a cross sectional view of a further embodiment of a finisher system according to the present invention.

Referring to FIG. 13, a further embodiment of the finisher system according to the present invention is shown which sets up a sheet piling device 21 downstream of a sheet path selector 17 in a sheet finishing path track. An explanation of the devices and portions explained above are omitted.

A sheet path from a sheet receiver 1 to the sheet path selector 17, a direct sheet feeding path 32 and a part of the finishing sheet path 213 are all straight. Furthermore, the finishing sheet path 213 between the sheet path selector 17 and a finisher 40 has a "U" shape. The sheet piling system 2' is set up on one side of the "U" shape in the finishing sheet path 213 between the sheet path selector 17 and a pair of eject rollers 24 and 25. A finishing tray of the finisher 40 is set up on the other side of the "U" shape in the finishing sheet path 213 between the pair of eject rollers 24, 25 and a pair of eject rollers 30, 31. Therefore, when the finisher system does not carry out a finishing operation of received sheets, the finisher system controls the sheet path selector 17 which selects the direct sheet feeding path 32 and directly transports the received sheets to a sheet stacker 50.

Still referring to FIG. 13, when the finisher system receives a sheet from an image forming apparatus at the image formed sheet receiver 1, the finisher system guides the sheet to the sheet path selector 17 by rotation of a pair of rollers 203 and 204.

When the finisher system carries out a finishing operation of the guided sheet, the sheet path selector 17 selects the finishing sheet path 225 and the sheet is transported to the sheet piling system 2' from the sheet path selector 17. The sheet piling system 2' has plural piling paths, including piling sheet path 201 and piling sheet path 202. Furthermore, the sheet piling system 2' has also has a piling path selector 210. The piling path selector 210 selects the piling sheet paths 201 and 202 based upon a control from a controller (not shown) and guides a sheet to a proper piling path. In detail, the piling path selector 210 guides a first sheet to first piling path 201, and guides a second sheet to second piling path 202. The piling path 201 includes a pair of rollers 206 and 207. The piling path 202 includes a pair of rollers 208 and 209. The rollers 206 and 208 are drive rollers. The rollers 207 and 209 are pressure rollers. A radius of the drive roller 206 in the piling path 201 can be a little smaller than a radius of the drive roller 208 in the piling path 202.

Figure 14:
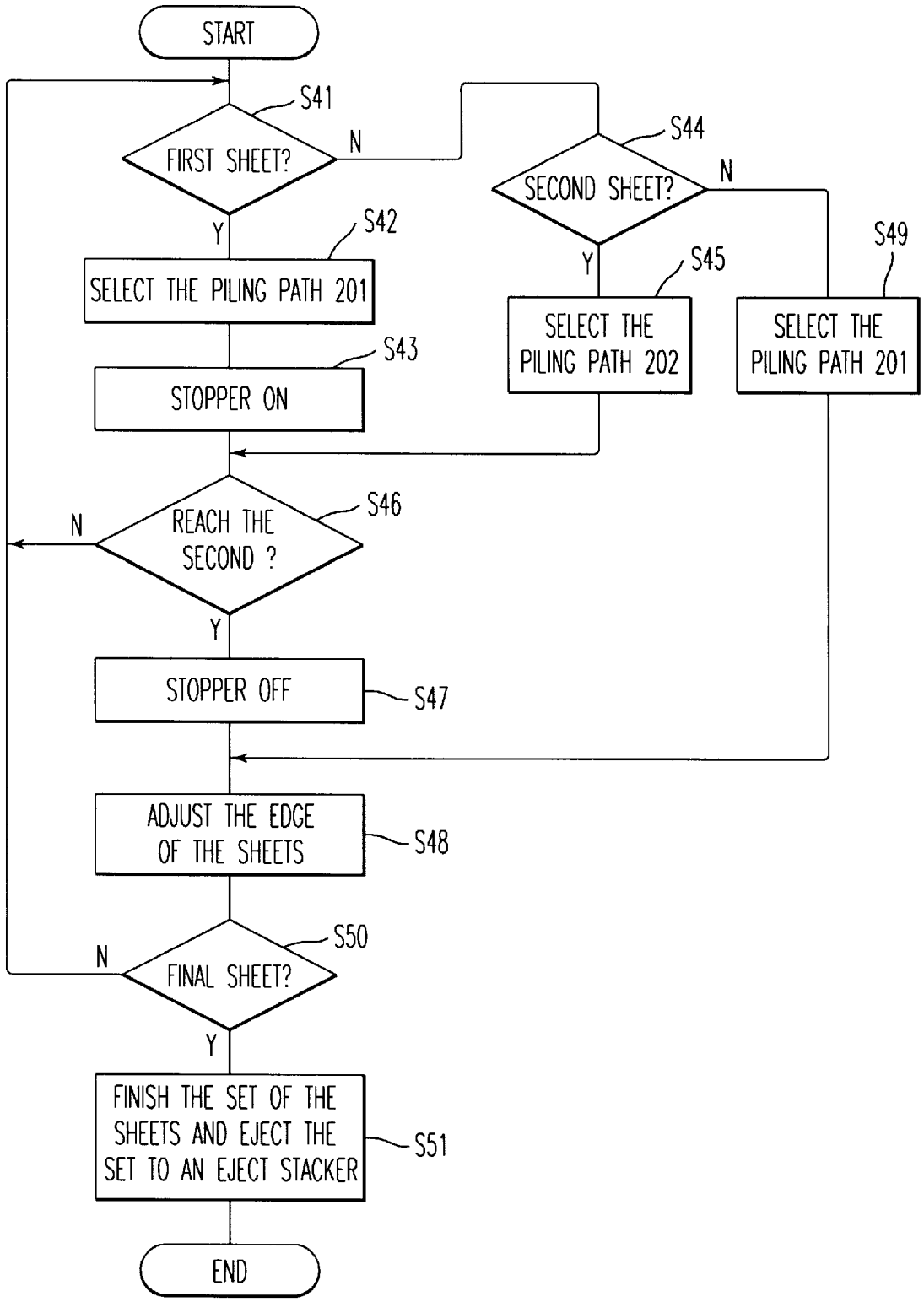
FIG. 14 is a flow chart illustrating steps involved in a fourth process performed by a sheet piling operation according to the present invention.

Now referring to FIG. 14, a preferred process of the finisher system of FIG. 13 is illustrated.

When the finisher system receives a sheet, the system detects whether the sheet is a first sheet or not in a step S41. In step S41, when the received sheet is the first sheet the operation proceeds to a step S42. On the other hand, in step S41 when the received sheet is not the first sheet, the operation proceeds to a step S44. In step S42, a piling path selector selects the piling path 201. The first sheet is then trapped by the stopper 215 in step S43 and the operation then proceeds to a step S46. If the second sheet is not trapped in step S46, the operation returns to step S41. If the second sheet is trapped in step S46, the operation proceeds to a step S47. In a case that the second sheet does not reach the finisher system and the first sheet is trapped, the operation proceeds to a step S44 by way of step S41. When the second sheet is received in the finisher system, the piling path selector 210 selects the sheet piling path 202 in a step S45 and the second sheet is trapped in a step S46. The operation then confirms a suspension of the second sheet in step S46.

The stopper 215 then releases both trapped sheets at the instant when the second sheet reaches the stopper 215 in a step S47. The released sheets are then transported to finisher 40 along finishing sheet path 213. When the sheets reach the finisher 40, an end edge of the sheets is adjusted at the finisher by side fences 42 and end fences 43 in a step S48. In a step S50, the operation confirms whether a sheet is a final sheet or not. When a sheet is not the final sheet, NO in step S50, the operation returns to step S41. Furthermore, when the received sheet is a third or further sheet, the sheet path is selected to the piling sheet path 201 again in a step S49. After the third sheet is transported in the finisher system, the stopper 215 is always open. Finally, when the received sheet is the final sheet, YES in step S50, the final sheet is transported to the finisher and the sheets are finished, e.g. stapled, in a step S51. Also in step S51, the finished set of sheets is ejected to sheet stacker 50.

In step S48, the adjusting roller 25 always rotates to adjust the last sheet of a set of sheets. When the adjustment of the last sheet is completed, the adjusting roller 25 slips with the last sheet. The finisher system also carries out the same operation on a second and further sets of sheets.

Therefore, the finisher system has a time interval between the ejection of a final sheet of a first set of sheets and the ejection of two piled sheets of a second set of sheets. The finisher system is capable of carrying out a finishing operation during the above interval time.

Similar as in the embodiment of FIG. 4, the finisher system can transport the second sheet to precede the first sheet to the finisher. The first sheet contacts the end fences 43 in the finisher 40 at first. The adjusting roller 25 contacts and adjusts the second sheet. Therefore, an end edge of the set of the sheets is properly adjusted in the finisher 40. Furthermore, when a radius of the drive roller 206 is equal to a radius of the drive roller 208, the finisher system is capable of transporting the second sheet, which precedes the first sheet, to the finisher system by changing the rotation speed of the drive roller 206 to be greater relative to that of drive roller 208.

Figure 15A:
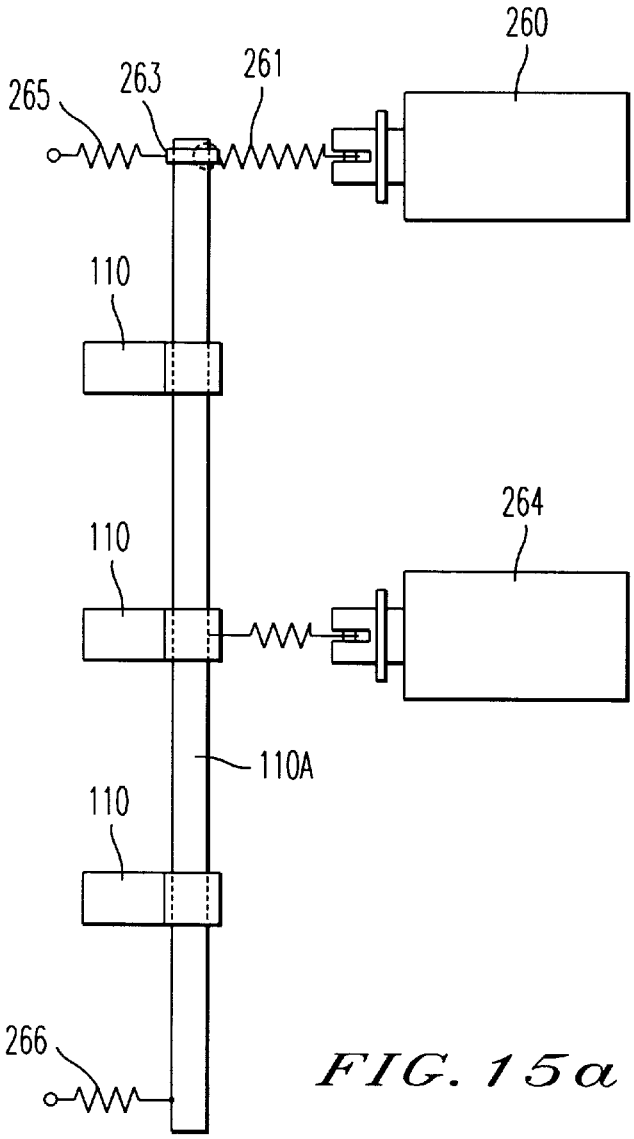
FIGS. 15(*a*) and 15(*b*) are top and side cross-sectional views of a sheet holding system in the fourth embodiment according to the present invention.
Figure 15B:
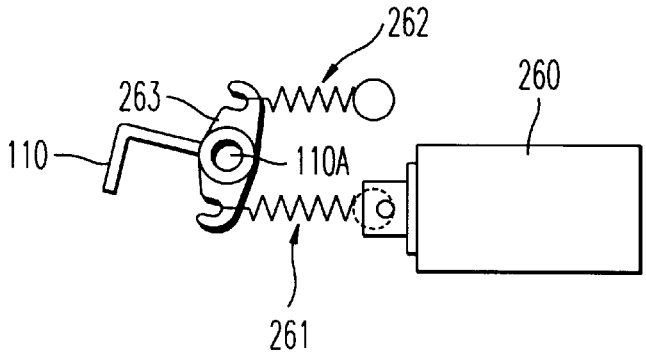

A preferred sheet piling system of a finisher system of a further embodiment of the present invention includes a sheet piling lever 110 as shown in FIG. 15 and FIG. 16. An explanation of the devices and portions explained above are omitted.

In this embodiment, the piling device 2 does not have multiple paths but instead has a single piling path guided with guide plates 101, 102 and 103, see FIG. 16. The piling device 2 is capable of piling received sheets because the sheet piling lever 110 holds down a trailing edge of each sheet when each sheet is fed in the piling system at each feeding.

Now referring to FIGS. 15(*a*) and 15(*b*), a drive system of a piling lever 110 is arranged in a sheet piling device. The piling lever 110 is set up on the shaft 110A and is supported in a vertical direction of the sheet transport direction in the drive system. One side of the shaft 110A supports a hook 263. One side of the hook 263 is connected to a solenoid actuator 260 via a spring 261 and another side of the hook 263 is fixed via spring 262. When the solenoid 260 retracts a tip of its shaft, one side of the hook 263 is pulled by the power of the spring 261. Then, the piling lever 110 is positioned to hold down a trailing edge of each sheet from a rotation around an axis of the shaft 110A. Furthermore, when the solenoid 260 extends the tip of its shaft, another side of the hook 263 is pulled by the power of the spring 262. Then, the piling lever 110 is positioned to release the trailing edge of each sheet from a rotation around an axis of the shaft 110A.

Still furthermore, a solenoid actuator 264 is set up on the shaft 110A by way of a spring 267. Springs 265 and 266 are also set up on both tips of the shaft 110A. The solenoid actuator 264 shifts the shaft 110A. When the solenoid actuator 264 retracts a tip of its shaft, the shaft 110A is pulled by the power of the spring 267 in an anti-sheet transport direction. On the other hand, when the solenoid actuator 264 extends a tip of its shaft, the shaft 110A is pulled by the power of the spring 265 and 266 in the sheet transport direction.

Now referring to FIG. 16, the drive system of the piling lever 110 carries out the following process.

Initially, the sheet piling lever 110 is located in the position A shown with a solid line in FIG. 16. When the first sheet is received in the finisher system, the sheet piling lever 110 shifts to a position B, shown with a dotted line along an arrow ①, by power of the spring 267 attached to the solenoid actuator 264. The first sheet is then trapped by a stopper 120 as well as the sheet piling lever 110 rotating to a position C, shown with a dotted line, by a rotation clockwise of lever 110 around an axis of the shaft 110A by the power of the spring 262, as shown as an arrow ②. The end edge of the first sheet at this time hangs down into the bending portion of the guide 103. When the second sheet is fed to the piling device, the second sheet is trapped by the stopper 120, and the piling lever 110 shifts to a position D, shown with a dotted line, by the power of the springs 265 and 266, as shown as an arrow ③. Thus, the lever 110 secures the trailing edge of the first sheet. This operation ensures that the second sheet is properly stacked on top of the first sheet by ensuring that the second sheet is not fed under the first sheet. Then, the piling lever 110 rotates counterclockwise around the axis of the shaft 110A, as shown an arrow ④, and returns to the position A, shown with a solid line.

The piling system is also capable of a proper piling of a third and further sheets by repeating the above process.

After piling of the predetermined last sheet in the piling device, the stopper 120 releases the set of sheets and the set of sheets is transported to the finisher. In this embodiment, the piling device is capable of piling sheets without the plural piling sheet paths because the piling lever 110 piles the received sheets by holding down a trailing end edge of the received sheets. Furthermore, a front edge of each sheet is suspended at the stopper 120, even if the received sheet is shifted in the sheet transport direction, because the front edge of the set of sheets is adjusted at the stopper 120.

Obviously, numerous additional modifications and variations of the present invention are possible in light of the above teachings. It is therefore to be understood that within the scope of the appended claims, the present invention may be practiced otherwise than as specifically described herein.

The present invention is based on the Japanese Priority Documents 09-002,227, 09-255,395, 09-213,532, 09-295, 813, 09-312,189, the contents of which are incorporated herein by reference.

What is claimed is:

1. A finisher system for image formed sheets transported from an image forming apparatus, comprising:

a finisher for finishing the image formed sheets;

a direct sheet feeding path for feeding the image formed sheets to a sheet stacker;

a sheet finishing path branched from said direct sheet path for transporting the image forming sheets to said sheet stacker by way of said finisher;

a sheet piling system set upstream from a turning point at which said sheet finishing path branches from said direct sheet feeding path for piling up the image formed sheets, wherein said sheet piling system includes plural sheet suspending paths which each suspend a respective sheet and which each include a sheet transport device; and a stopper set upstream from said turning point for temporally trapping said image formed sheets.

2. A finisher system for an image formed sheet according to claim 1, wherein said stopper comprises a pair of rollers whose driving can be independently controlled.

3. A finisher system for an image formed sheet according to claim 1, wherein said stopper comprises a plate.

4. A finisher system for an image formed sheet according to claim 1, wherein said stopper is set between said sheet piling system and said turning point.

5. A finisher system for an image formed sheet according to claim 1, wherein said stopper is set in said sheet piling system.

6. A finisher system for an image formed sheet according to claim 4, wherein said stopper is set between said turning point and said sheet transport devices of said sheet piling system.

7. A finisher system for an image formed sheet according to claim 6, wherein each of said sheet transport device comprises a pair of rollers.

8. A finisher system for an image formed sheet according to claim 6, wherein said stopper is set in each said sheet suspended path.

9. A finisher system for an image formed sheets according to claim 1, wherein said stopper is set in said sheet finishing path downstream from said turning point.

10. A finisher system for image formed sheets according to claim 1, further comprising:

a lever set up in said piling system upstream from said stopper in the sheet transport direction for temporally trapping and piling said image formed sheets by holding an end of the image formed sheets.

11. A finisher system for image formed sheets according to claim 1, wherein said sheet piling system piles each of plural image formed sheets with a shifted position toward a transport direction.

12. A finisher system for image formed sheets according to claim 11, further comprising:

a sheet adjusting device set in said finisher; and said sheet piling system piles each of plural image formed sheets and shifts an image formed sheet with a delayed position toward a transport direction on a side of said sheet adjusting device.

13. A finisher system for image formed sheets according to claim 11, further comprising:

a pair of rollers set in said sheet piling system for transporting each image formed sheet with a different speed.

14. A finisher system for image formed sheets according to claim 13, wherein said rollers of said pair of rollers each have a different radius.

15. A finisher system for image formed sheets according to claim 13, wherein said rollers of said pair of roller rotate with different rotation speeds.

16. A finisher system for image formed sheets according to claim 1, wherein said stopper releases said image formed sheets with a different timing.

17. A finisher system for image formed sheets according to claim 1, wherein said direct sheet feeding path and said sheet finishing path have different lengths.

18. A finisher system for image formed sheets according to claim 1, wherein said stopper traps said image formed sheets with a shifted position toward a sheet transport direction.

19. A finishing system for image formed sheets transported from an image forming apparatus, comprising:

a finishing means for finishing the image formed sheets;

a direct sheet feeding path means for directly feeding the image formed sheets to a sheet stack means;

a sheet finishing path means for transporting the image forming sheets to said sheet stack means by way of said finishing means;

a sheet piling means for piling up the image formed sheets, wherein said sheet piling system includes plural sheet suspending path means which each suspend a respective sheet and which each include a sheet transport; and a stopper means for temporally trapping said image formed sheets.

20. A finisher system for image formed sheets according to claim 19, wherein said stopper is set between said sheet piling means and a turning point at which said sheet finishing path means branches from said direct sheet feeding path means.

21. A finisher system for image formed sheets according to claim 19, wherein said stopper means is set in said sheet piling means.

22. A finisher system for image formed sheets according to claim 19, wherein said stopper means is set between said turning point and said sheet transport means of said sheet piling means.

23. A finisher system for image formed sheets according to claim 22, wherein said stopper means is set in each said sheet suspended path means.

24. A finisher system for image formed sheets according to claim 19, wherein said stopper means is set in said sheet finishing path means downstream from said turning point.

25. A finisher system for image formed sheets according to claim 19, wherein said sheet piling means piles each of plural image formed sheets with a shifted position toward a transport direction.

26. A finisher system for image formed sheets according to claim 19, further comprising:

a sheet adjusting means set up in said finishing means; and wherein said sheet piling means piles each of plural image formed sheets and shifts an image formed sheet with a delayed position toward a transport direction on a side of said sheet adjusting means.

27. A finisher system for image formed sheets according to claim 19, wherein said stopper means temporally releases said image formed sheets different timings.

28. A finisher system for image formed sheets according to claim 19, wherein said direct sheet feeding path means and said sheet finishing path means have different lengths.

29. A finisher system for image formed sheets according to claim 19, wherein said stopper means temporally traps said image formed sheets with a shifted position toward a sheet transport direction.

* * * * *